US006392355B1

(12) United States Patent
Palmer et al.

(10) Patent No.: US 6,392,355 B1
(45) Date of Patent: May 21, 2002

(54) CLOSED-LOOP COLD CATHODE CURRENT REGULATOR

(75) Inventors: William Devereux Palmer, Durham; Dorota Temple, Cary, both of NC (US)

(73) Assignee: MCNC, Research Triangle Park, NC (US)

( * ) Notice: Subject to any disclaimer, the term of this patent is extended or adjusted under 35 U.S.C. 154(b) by 0 days.

(21) Appl. No.: 09/557,533

(22) Filed: Apr. 25, 2000

(51) Int. Cl.[7] ..... G09G 3/10

(52) U.S. Cl. ..... 315/169.1; 315/291; 315/307; 315/209 R; 345/204; 345/212

(58) Field of Search ..... 315/307, 169.1, 315/169.4, 224, 291, 209 R; 345/204, 212

(56) References Cited

U.S. PATENT DOCUMENTS

| | | | | |
|---|---|---|---|---|
| 3,890,537 | A | 6/1975 | Park et al. | 315/208 |
| 3,936,756 | A | 2/1976 | Someya et al. | 328/9 |
| 4,010,401 | A | 3/1977 | Yasumatsuya et al. | 315/379 |
| T961,002 | I4 | 8/1977 | Hall et al. | 315/107 |

(List continued on next page.)

FOREIGN PATENT DOCUMENTS

| | | |
|---|---|---|
| EP | 0 665 573 A1 | 8/1995 |
| EP | 0 833 359 A2 | 4/1998 |
| GB | 1 380 126 | 1/1975 |
| WO | WO 96/42101 | 12/1996 |
| WO | WO 99/49445 | 9/1999 |

OTHER PUBLICATIONS

Junji Itoh, Takayuki Hirano, and Seigo Kanemaru, Ultrastabel emission from a metal–oxide–semiconductor field–effect transistor–structured Si emitter tip, Appl. Phys. Lett. 69 (11), Sep. 9, 1996, 1577–1588, American Institute of Physics.

Walter G. Jung, Op–Amp Applications, IC Op–Amp Cookbook, 1997, 208–209, 3rd Ed., SAMS, USA.

Kenneth Grossman and Martin Peckerar, Letter to the Editor: Active current limitation for cold–cathode field emitters, Dec. 29, 1994.

P. Morin, C. Rolland, M. Pitaval and E. Vicario, Electronic Device to Remove Effects of Field Emission Instability on Display in Scanning Electron Microscopy, Revue De Physique Appliquee, Jan. 13, 1978, 39–41, Department de Physique Materiaux, France.

*Primary Examiner*—David H. Vu
*Assistant Examiner*—Tuyet T. Vo
(74) *Attorney, Agent, or Firm*—Alston & Bird LLP

(57) ABSTRACT

A current regulator controls the electron emission from a cold cathode using closed-loop feedback from a current sensor in the cathode connection. The regulator circuit includes a cold cathode, a current-sensing element, a current-limiting element, and current-control element. Additionally, the closed-loop current regulator may comprise a reference element for generating the reference level, a circuit power supply and a cathode bias supply. The regulator and cathode may be assembled from separate components, or the entire circuit may be integrated onto a single substrate. In one embodiment, the current level is set by adjusting the reference element directly. In a second embodiment, the current level is set by adjusting the circuit power supply, so that the current level can be set remotely without the need to adjust the reference element directly. The second embodiment is preferably suited for the regulation of beam current in analytical instrumentation. In a third embodiment, the fixed reference element is replaced with a time-varying voltage signal. The current from the cathode then becomes a linear function of the time-varying reference signal. The third embodiment is preferably suited for application as an amplifying element or as the electron source in an emissive display.

6 Claims, 5 Drawing Sheets

U.S. PATENT DOCUMENTS 4,090,106 A 5/1978 Okumura et al. ..... 315/107
4,275,347 A 6/1981 Farmer, Jr. et al. ..... 323/312
4,322,625 A 3/1982 Daniels et al. ..... 250/409
4,467,205 A 8/1984 Beisswenger et al. ..... 250/397
4,492,899 A 1/1985 Martin ..... 315/308
4,572,990 A 2/1986 Leale et al. ..... 315/220
4,733,530 A 3/1988 Beattie et al. ..... 60/202
4,973,890 A 11/1990 Desjardins ..... 315/383
4,994,954 A 2/1991 Katz et al. ..... 363/89
5,030,887 A 7/1991 Guisinger ..... 315/158
5,059,869 A 10/1991 Albach et al. ..... 315/289
5,075,595 A 12/1991 Kane ..... 315/169.1
5,173,634 A 12/1992 Kane ..... 313/306
5,235,254 A 8/1993 Ho ..... 315/219
5,347,197 A 9/1994 Doyle et al. ..... 315/94
5,384,516 A 1/1995 Kawabata et al. ..... 315/160
5,416,387 A 5/1995 Cuk et al. ..... 315/209 R
5,422,545 A 6/1995 Felper et al. ..... 315/209 R
5,548,189 A 8/1996 Williams ..... 315/224
5,615,093 A 3/1997 Nalbant ..... 363/25
5,652,479 A 7/1997 LoCascio et al. ..... 315/225
5,656,892 A 8/1997 Zimlich et al. ..... 315/169.3
5,698,952 A 12/1997 Stebbins ..... 315/307
5,710,478 A 1/1998 Kanemaru et al. ..... 313/336
5,719,477 A 2/1998 Tomihari ..... 315/381
5,726,536 A 3/1998 Hagiwara ..... 315/276
5,734,232 A 3/1998 Hendrix et al. ..... 315/307
5,747,942 A 5/1998 Ranganath ..... 315/224
5,754,012 A 5/1998 LoCascio et al. ..... 315/307
5,767,630 A 6/1998 Williams ..... 315/282
5,780,318 A 7/1998 Hirano et al. ..... 438/20
5,796,213 A 8/1998 Kawasaki ..... 315/209 R
5,818,172 A 10/1998 Lee ..... 315/86
5,834,907 A 11/1998 Takehara ..... 315/307
5,834,908 A 11/1998 Boland et al. ..... 315/307
5,844,378 A 12/1998 LoCascio et al. ..... 315/307
5,847,408 A 12/1998 Kanemaru et al. ..... 257/10
5,854,543 A 12/1998 Satoh et al. ..... 315/307
5,892,321 A 4/1999 Itoh et al. ..... 313/336
5,923,129 A 7/1999 Henry ..... 315/307
6,002,209 A 12/1999 Wang et al. ..... 315/169.1
6,031,344 A * 2/2000 Foo et al. ..... 315/307
6,040,973 A * 3/2000 Okamoto et al. ..... 361/235
6,060,840 A 5/2000 Foo et al. ..... 315/169.1
6,144,374 A * 11/2000 Hyun ..... 345/204

* cited by examiner

CLOSED-LOOP COLD CATHODE CURRENT REGULATOR

FIELD OF THE INVENTION

The present invention relates generally to cold cathode devices and associated applications and, more particularly, to a closed-loop circuit that can stabilize the emission of the cold cathode.

BACKGROUND OF THE INVENTION

A cold cathode is an electron emitter whose emission mechanism is field-based rather than temperature-based. Field-based electron emission occurs when a high electric field is applied to the surface of the cathode's emitter material residing in a vacuum environment. A tunneling effect allows electrons to pass from the emitter into the vacuum, producing a flow of electrons as defined by the Fowler-Nordheim equation. This tunneling effect is strongly dependent on the surface work function of the emitter material. The surface work function is an inherent property of the emitter material that is affected by surface contamination. Since no vacuum environment can be contamination-free, there is a continuous flux of surface contaminants being carried onto and off of the emitter surface, resulting in wide fluctuations of the emission current on both short and long time scales.

The surface contamination effect is especially problematic in cold cathode applications. Unlike thermal cathodes, which operate at temperatures above 1000° C., the cold cathode is incapable of boiling off impurities on the surface of the emitter. In devices utilizing cold cathodes water vapor and other background gasses are constantly being absorbed and desorbed on the surface of the cathode which changes the surface work function and causes fluctuations in the emission.

Thermionic cathodes, which are commonly used in many applications, such as CRT displays, vacuum tubes for audio amplification, vacuum tubes for microwave power amplification, and cathodes for analytical instrumentation and the like, characteristically differ from cold cathodes in that they employ temperature-based electron emission. The electron emission from thermionic cathodes is a function of the power applied to the cathode that determines the operating temperature of the cathode through Joule heating. Thus, the thermionic cathode is considered a power-controlled current source. When the cathode is emitting the maximum current possible for a given temperature, it is said to be operating in emission-limited mode. This mode produces the highest operating current for a given temperature, but can produce unstable emission since the emission from the thermionic cathode is also a strong function of the surface work function. However, since these cathodes are typically operated at above 1000° C. adsorption of contaminants is minimized, so thermionic cathodes typically operate at much lower noise levels than cold cathodes and thus stabilization concerns are not as prevalent. Further stabilization of the emission current of a thermionic cathode can be achieved by operating the cathode in space-charge-limited mode, where the anode voltage and geometry limit the maximum allowed current density as defined by the Langmuir-Child relation.

Since the emission from cold cathodes is field-based, and fields are generally a function of applied voltage, cold cathodes are considered voltage-controlled current sources. When the cathode is operating at the maximum emission current possible for a given control voltage, the cold cathode is said to be operating in emission-limited mode. This mode maximizes the output current from the cathode, but, as described above, produces unstable or noisy emission current. Stability of the cold cathode is a paramount concern in most electron-beam devices that employ a cold cathode, such as audio, video or radar applications. In radar applications noise translates into a degraded signal that reduces the overall detection efficiency. In video applications, noise translates into visual artifacts or uneven brightness present on the monitor.

Several schemes to minimize emission current noise in cold cathodes have recently been developed. See for example, U.S. Pat. No. 5,847,408, entitled "Field Emission Device," issued Dec. 8, 1998 in the name of inventors Kanemaru, et. al. and U.S. Pat. No. 5,173,634, entitled "Current Regulated Field-Emission Device," issued Dec. 22, 1192 in the name of inventor Kane. Of these schemes, the most prevalent are passive stabilization, most often embodied by incorporation of a resistor or resistive layer into the cathode, and active stabilization, most often embodied by incorporation of a MOSFET or other type of transistor in the cathode circuit. Both of these schemes are open-loop control schemes; that is, they attempt to control emission current without incorporating any measurement of the actual emission current for corrective feedback. Additionally, material changes to the cathode, in the form of changes to the emitter material and the use of coatings on the emitter, have been proposed as means of limiting noise and increasing cathode stabilization.

Passive stabilization seeks to control the emission current by reducing the applied voltage as the emitted current increases. This open-loop scheme is only partially successful, because the emitted current tends to be an exponential function of the applied voltage, while the resistor can provide only a linear reduction in voltage as a function of the emission current. In other words, it is mathematically impossible for the linear passive stabilization scheme to keep up with the exponential fluctuations in emission.

Active stabilization represents an improvement over passive stabilization, in that the transistor element is used as a current-limiting element in the circuit. In this open-loop scheme, the transistor limits the supply of electrons to the cathode, which in turn limits the emission current. In other words, the cathode can only emit electrons if electrons are available. Under these conditions, the cathode is said to be operating in supply-limited mode. This operating mode for cold cathodes is analogous to space-charge-limited mode for thermionic cathodes. In this mode, the stability of the emitted current is directly dependent on the stability of the current-limiting element, which can vary greatly depending on external factors such as temperature, supply voltage variations, and others. Thus, in active stabilization schemes if the current-limiting element is unstable, the resulting emitted current will also be unstable. This is apparent because of the open-loop circuitry which provides for no measurement of the actual emission current for corrective feedback.

Additionally, attempts have been made to address cold cathode stabilization problems by using different emitter materials or coatings on the cathode. Coatings have been used to make the surface of the emitter more inert and thereby raise the surface work function. Alternately, cathodes have been fabricated out of highly resistive materials to allow for a negative feedback mechanism to be built into the cathode's structure. Implementation of these material changes to the cold cathode has proven to have minimal positive effect on the stabilization concerns.

A desired cold cathode stabilization scheme would depart from these open-loop circuit methods in that the stabilization scheme would control emission current by providing corrective feedback to a measured emission current. It would be desirable to provide for a cold cathode circuit that regulates the emission current using closed-loop feedback. Additionally, the emission current of the cold cathode would benefit from regulation that can be provided remotely, without direct adjustment of the circuit.

SUMMARY OF THE INVENTION

The present invention provides for improved stability for the emission current of cold cathode technologies. Addition of a closed-loop current regulating circuit enables practical application of cold cathode technology in areas where cathode noise and instability have historically been insurmountable limiting factors.

A closed-loop, cold cathode current regulator in accordance with the present invention comprises a cold cathode having an emitter and an electrode that cooperates to extract electrons from the emitter, a current limiting element that controls the flow of electrons to the emitter in response to a control signal, a current sensing element that produces an output signal that is a function of the current flowing from the emitter and a current control element that based upon the output signal of the current sensing element and a reference level produces the control signal.

In one embodiment of the invention the reference level is produced by a reference element that provides a fixed set point input to the current control element. The reference element may comprise a resistive voltage divider that derives a voltage output signal from the circuit power supply. In an additional embodiment of the invention the reference element may include a resistive voltage divider and a non-inverting gain element. In this embodiment the voltage output signal is derived from the circuit power supply, but with a rate of change that differs from that of the circuit power supply.

In an alternate embodiment of the invention the reference level is produced by a time-varying input source. The time variation may represent the transmission of analog or digital information that can be intended for aural, visual or data processing interpretation.

Additionally, the current regulator circuit of the present invention may include a circuit power supply, which may provide power to the circuit at a fixed direct-current (DC) voltage. Alternatively, the circuit power may be derived from an alternating-current (AC) source, transformer-coupled, with rectifier and filter circuitry that can allow the voltage applied to the circuit to vary in proportion to the magnitude of the AC source at the input. The regulator circuit also may include, if required for the particular cold cathode of interest, a cathode bias supply that can draw power either from the supply for the current regulating circuit or from an external source.

Additionally the present invention is embodied in a method for regulating current in a cold cathode using a closed-loop circuit. The method comprises producing a reference level based upon a set point current for a cold cathode emitter, producing a sensing output that is a function of the current flowing from the emitter, comparing the sensing output and the reference level to produce a control signal and regulating the flow of electrons to a cold cathode in response to the control signal.

As such, the present invention is capable of providing for a closed-loop regulator circuit that provides field-based, cold cathodes with markedly improved current stabilization. Additionally, further embodiments of the invention allow the emission current to be controlled remotely, without direct adjustment of the circuit. These benefits have wide spread applicability to numerous cathode devices, including but not limited to, analytical devices (e.g. scanning electron microscopes), CRT monitors and the like.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
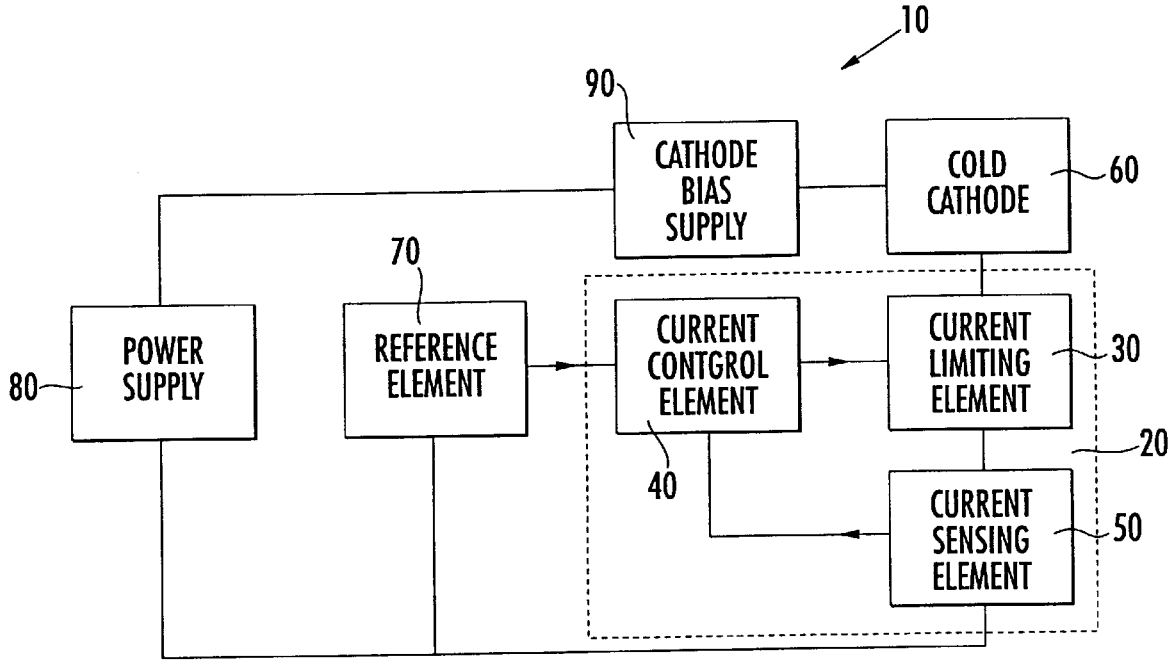
FIG. 1 is a functional block diagram of the elements of the closed-loop, cold cathode current regulator in accordance with an embodiment of the present invention.

FIG. 1 is a block diagram that represents the elements that comprise a closed-loop cold cathode current regulator 10 in accordance with an embodiment of the present invention. The present invention provides for a circuit that is capable of regulating the emission current from a cold cathode using closed-loop control. The closed-loop control aspect of the invention provides for considerable improvement of the emission current stability. In accordance with embodiments of the invention, discussed at length below, the emission current may be controlled with a fixed voltage, with a remotely controlled variable voltage or a time-varying control.

Referring to FIG. 1, the closed-loop control circuit 20 includes a current limiting element 30, a current control element 40 and a current sensing element 50. These components, in conjunction with a cold cathode 60, provide for a closed-loop cold cathode regulator circuit in accordance with the present invention. The cold cathode will typically include an emitter and an electrode that cooperate to extract electrons from the emitter when voltage is applied thereto. Cold cathodes are characterized as being field-based emission cathodes, as opposed to the more commonly employed temperature-based emission cathodes. The concepts and use of cold cathodes are well known by those of ordinary skill in the art. Further implementation of cold cathodes in numerous applications has been impeded by the unstable nature of the emission process.

The current limiting element 30 is in electrical communication with the cold cathode 60 and serves to control the flow of electrons to the emitter in the cold cathode in response to a control signal. The current limiting element is able to control electron flow by limiting the amount of current flowing through the element itself in response to the control signal. The current sensing element 50 is in electrical communication with the current limiting device and produces an output signal that is a function of the current flowing through the cold cathode and the current sensing element. The current control element 40 is responsive to the current sensing element and produces the control signal based upon a comparison of the output signal of the current sensing element and a reference level.

The closed-loop cold cathode regulator circuit 20 also includes a reference element 70 that is in electrical communication with the current control element 40 and provides a set point input (i.e. reference level) to the current control element. Depending on the physical embodiment of the reference element, the voltage output signal may be derived from different combinations of sources and rates of voltage change conducive to the requirements of the cold cathode application. Various reference element configurations form embodiments of the present invention and will be discussed in detail below. The closed-loop regulator circuit may also include a circuit power supply 80 in electrical communication with the emitter of the cathode, as well as, other circuit components. The circuit power supply may comprise a direct-current (DC) power supply that provides the circuit with a fixed voltage. Alternately, the circuit power supply may comprise an alternating-current (AC) power supply that provides the circuit with varying voltage in proportion to the magnitude of the AC source at the input.

Additionally, the closed-loop cold cathode current regulator 10 may comprise a cathode bias supply 90 in electrical communication with the cold cathode, if the cold cathode employed requires such. The cathode bias supply provides the cold cathode with power and can draw power from either the circuit power supply 80 or an external power source. The bias supply is typically used with gated field emitter arrays, and provides power to the gate electrode of the cathode. In both DC and AC power supply embodiments, the circuit may also include additional protection components (not shown in FIG. 1) that protect the circuit from reversal of the input voltage polarity or momentary or continuous supply fault conditions.

Figure 2:
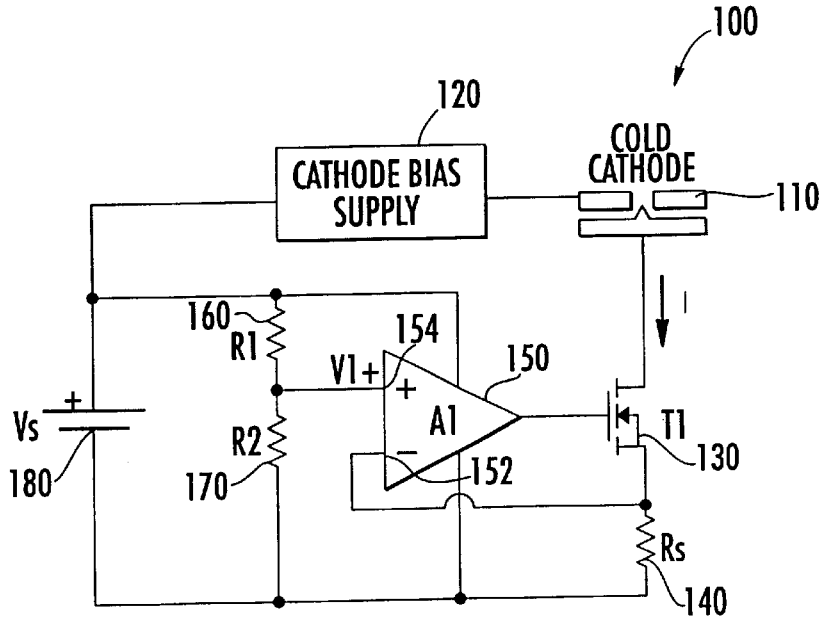
FIG. 2 is a schematic drawing of current regulating circuit in which the power supply voltage is taken to be fixed, and the set point of the current regulating circuit is derived directly from the power supply voltage in accordance with an embodiment of the present invention.

Referring now to FIG. 2, shown is a schematic drawing of current regulating circuit 100 in accordance with an embodiment of the present invention. A gated field emission (i.e. cold) cathode 110 is typically micromachined from a silicon substrate. The remaining components of the current regulating circuit may be assembled from separate components, or the entire circuit may be integrated onto a single substrate. In the embodiment shown, the cathode is in electrical communication with a cathode bias supply 120, which is set to a bias point well above that expected to be required for the desired regulated current set point. As previously discussed the cathode bias supply is an optional element of the circuit and is only required in those applications in which the cathode requires a bias voltage supply. A current (I) flows through the cathode as a result of electron emission from the cathode.

The field emission cathode is further in electrical communication with a transistor (T1) 130, typically a MOSFET transistor that represents the current limiting element in this embodiment. The current limiting element may also comprise a series of transistors or other components that can limit the amount of current flowing through the element itself in response to a control signal thereby controlling the flow of electrons to the emitter in the cathode.

The field emission cathode is further in electrical communication with a resistor (Rs) 140 that serves as the current sensing element in this embodiment. The current sensing element may also be embodied in a combination of other like elements that can produce an output signal that is a function of the current flowing through the cathode's emitter. An operational amplifier (A1) 150 is responsive to the resistor 140 and serves as the current control element in this embodiment. The current control element may also be embodied in other components capable of receiving a reference signal indicating the target current level and the output signal of the control sensing element (resistor 140) and converting these inputs into an output signal that appropriately adjusts the control signal to the current limiting element (transistor 130).

In operation, this current flow produces a voltage across resistor 140 according to Ohm's Law, such that $V=I\times R_s$. The operational amplifier 150 will adjust its output such that the voltages at the input terminals 152 and 154 are equal, or in this case that the voltage V1+ appearing at the positive input 154 to the amplifier is equal to the voltage across resistor (Rs) 140 produced by the current flow through the cathode 110. With the configuration shown in FIG. 2, this changes the bias point of transistor 130, resulting in a regulated current equal to $I=(V1+)R_s$. The resistors (R1) 160 and (R2) 170 collectively, form a resistive voltage divider that serves as the reference element. The resistive voltage divider produces the desired reference voltage (V1+) derived from the circuit power source, depicted in this embodiment as supply voltage (Vs), 180.

Figure 3:
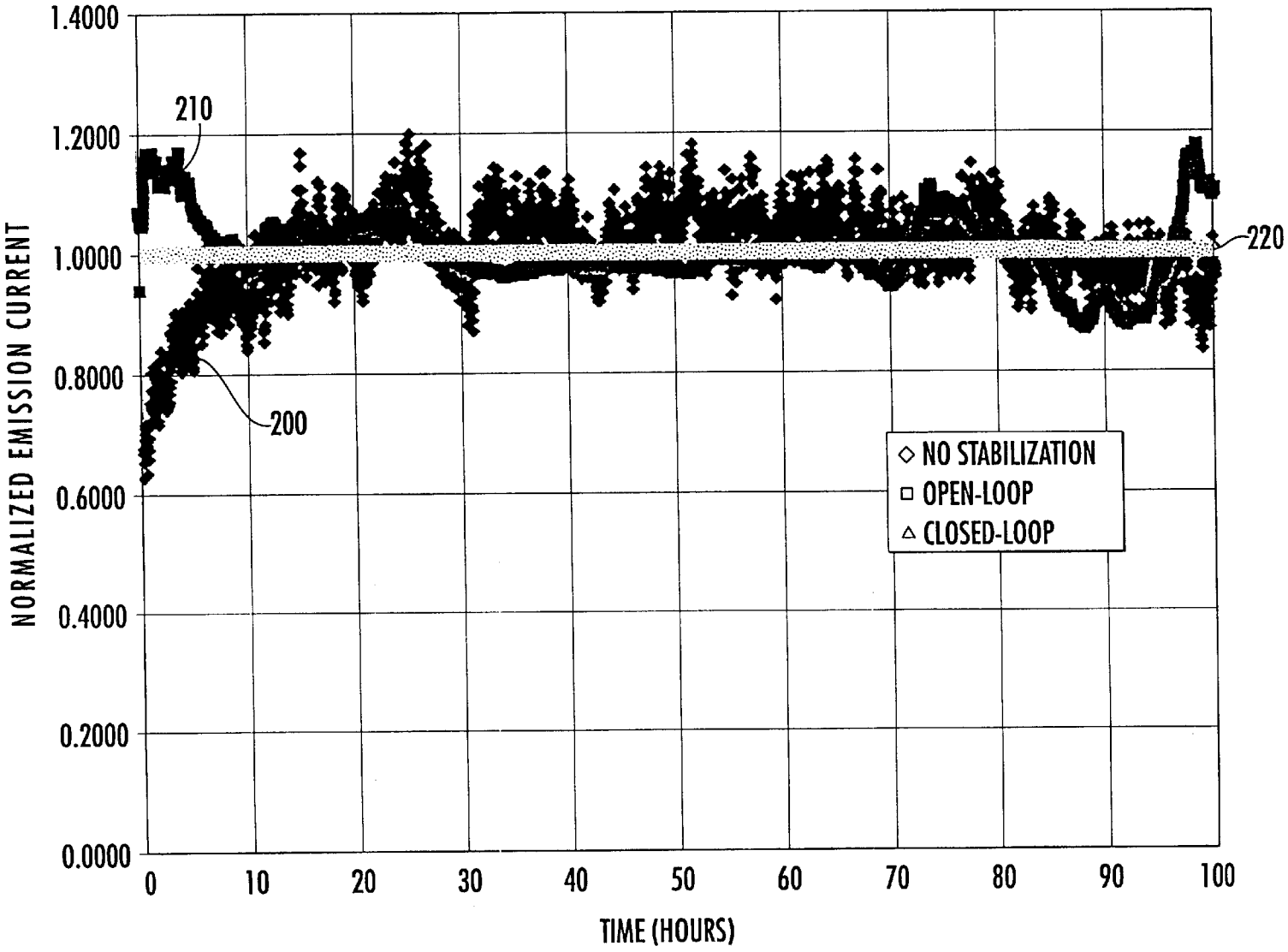
FIG. 3 is a graph of experimental data comparing the performance of an unregulated gated field emission cathode, a regulated cathode with an open-loop control system, and regulated cathode with a closed-loop control in accordance with a FIG. 2 embodiment of the present invention.

Referring now to FIG. 3, shown is a graphical representation of the cathode stabilization resulting from applying the current regulator circuit of FIG. 2 to an exemplar gated field emission cathode micromachined from a silicon substrate. The x-axis represents the duration of the cathode operation in hours and the y-axis represents normalized emission current with 1.0 being the set point state. The three curves represent actual data taken from the same field emission cathode. The first curve 200 represents the cathode with no emission current stabilization. The second curve 210 represents the cathode regulated with an open-loop control system as presented in the prior art. The third curve 220 represents the cathode regulated with the current regulator circuit of FIG. 2, in accordance with an embodiment of the present invention. In each case, the cathode, and external circuitry in the second and third cases, was adjusted to the target emission current level at the beginning of the experiment, and the experiment was left to run without further adjustment for 100 hours or more. After completion of the 100 hour operation period, the percentage error of the measured current from the set point was calculated. The coefficient of variation (COV, defined as the standard deviation of the data divided by the mean of the data) was also calculated as a measure of the stability of the emitted current. Data for the first 100 hours of each case is shown in FIG. 3. Data collected after the first 100 hours is substantially the same. The results of the three iterations of the experiment are given in Table 1 as follows:

TABLE 1

| Case | Error From Set Point | COV |
|---|---|---|
| No Stabilization | 51.7% | 7.5% |
| Open-Loop Control | −6.7% | 5.8% |
| Closed-Loop Control | 0.7% | 0.1% |

The case with no means of stabilization control shows the short time scale noise and long time scale drift typical of a field-based emission cathode operating in emission-limited mode. The open-loop control offers an improvement in the current set point and stability on a short time scale, but shows considerable drift on a long time scale due to variation in the characteristics of the current limiting element (most likely due to ambient temperature). As the graphical representation of FIG. 3 and error percentage and coefficient of variation data indicate the greatest level of accuracy and stability is achieved with the closed-loop control offered by the present invention. Minimal variation, in the range of 0.1% COV, can be achieved with the closed-loop control regulator circuit of the present invention.

Figure 4:
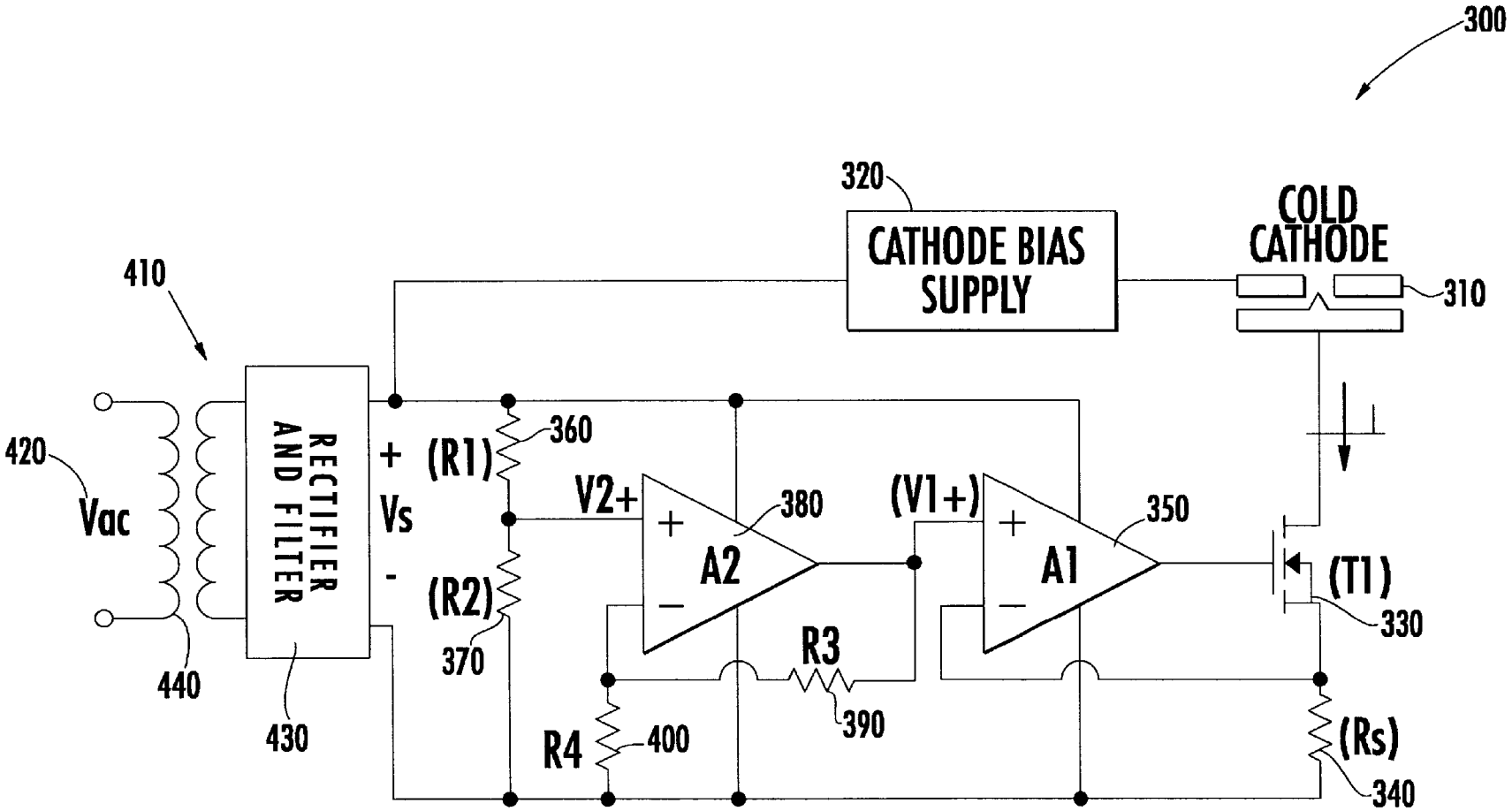
FIG. 4 is a schematic drawing of a current regulating circuit in which the power supply voltage for the regulating circuit is derived from an external AC source, and the set point of the circuit is derived from the power supply voltage with the addition of a gain element, so that the set point can be made to vary at a different rate than the power supply voltage, in accordance with an embodiment of the present invention.

FIG. 4 illustrates a schematic diagram of an alternate embodiment of a current regulating circuit 300 in accordance with the present invention. The cathode circuit and current regulating circuit are substantially the same as indicated in the FIG. 2 embodiment. A gated field emission (i.e. cold) cathode 310 is typically micromachined from a silicon substrate. The remaining components of the current regulating circuit may be assembled from separate components, or the entire circuit may be integrated onto a single substrate. The cathode is in electrical communication with an optional cathode bias supply 320, which is set to a bias point well above that expected to be required for the desired regulated current set point. A current (I) flows through the cathode as a result of electron emission from the cathode.

The field emission cathode 310 is further in electrical communication with a transistor (T1) 330, typically a MOSFET transistor that represents the current limiting element in this embodiment. The field emission cathode is further in electrical communication with a resistor (Rs) 340 that serves as the current sensing element in this embodiment. An operational amplifier (A1) 350 is responsive to the resistor 340 and serves as the current control element in this embodiment.

Resistors (R1) 360 and (R2) 370 collectively, form a resistive voltage divider that serves as a component for the reference element of the current regulating circuit 300. The reference circuit additionally includes an operational amplifier (A2) 380 and resistors (R3 and R4) 390 and 400 configured as a non-inverting gain block. The non-inverting gain block allows the resistive voltage divider to derive a voltage output signal (V1+) that has a rate of change different from that of the voltage of the circuit power supply 410. The circuit power supply of this embodiment derives a power supply voltage (Vs) from an external alternating-current (AC) source 420. As depicted, the AC source is coupled to a rectifier and filter circuit 430 by a transformer 440, as such the power supply voltage varies as a function of the AC source voltage. Thus, the current regulating circuit 300 is isolated from the current control input by the input transformer, and can be controlled in exactly the same manner as existing electron sources for analytical instrumentation. Therefore, this embodiment of the invention is preferably suited for the regulation of beam current in analytical instrumentation.

Figure 5:
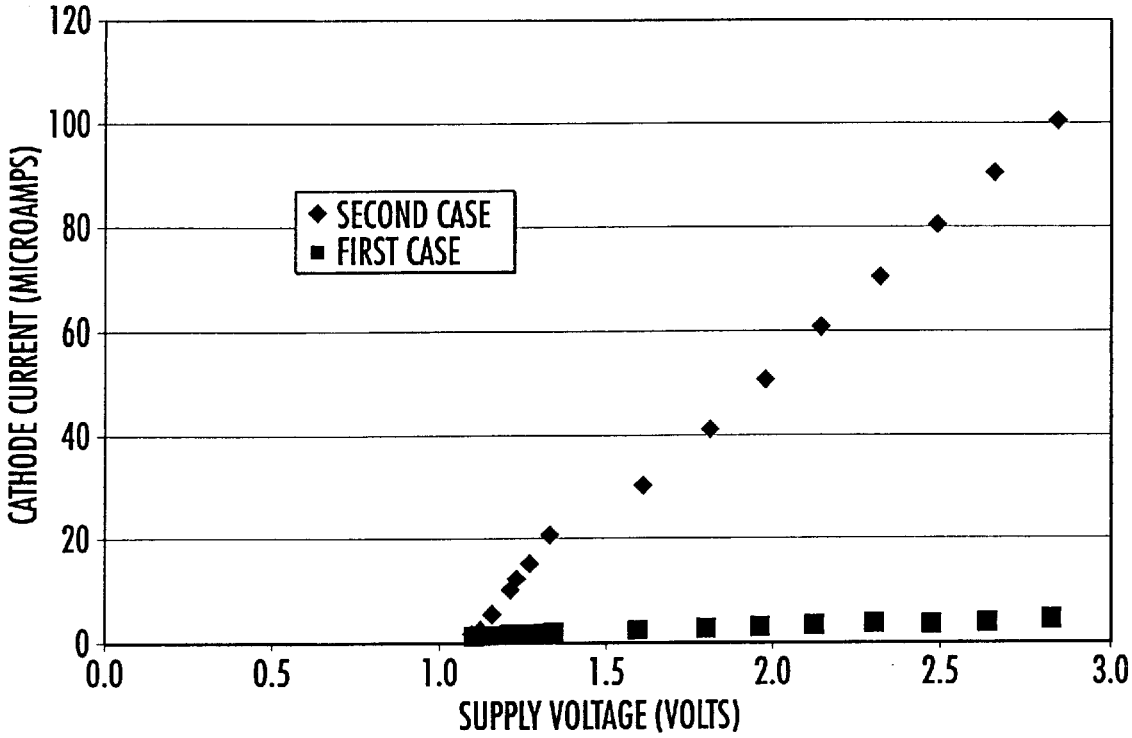
FIG. 5 is a graph of experimental data showing the variation in current set point as a function of supply voltage for the FIG. 2 and FIG. 4 embodiments of the present inventions, showing that the regulated current level can be made to vary at a rate substantially different than the rate of variation of the power supply voltage.

Referring now to FIG. 5, shown is a graphical representation of experimental data showing the variation in current set point as a function of supply voltage for the embodiments of the invention shown in FIGS. 2 and 4. The x-axis represents supply voltage and the y-axis represents cathode current. In a first case (denoted FIG. 5 by square indices), the power supply described in FIG. 4 was connected as Vs in the circuit described in FIG. 2. As the supply voltage was varied from 1 to 3 volts, the regulated emission current varied from 1 to 3 microamperes. In the second case (denoted in FIG. 5 by diamond indices), the circuit of FIG. 4 was used as described above, with resistors (R3 and R4) 390 and 400 adjusted to provide a voltage gain of approximately 30 in the reference circuit. In the second case, as the power supply was adjusted from 1 to 3 volts, the regulated emission current varied from 1 to approximately 100 microamperes. This represents a typical range of output current for cathodes used in analytical instrumentation.

Figure 6:
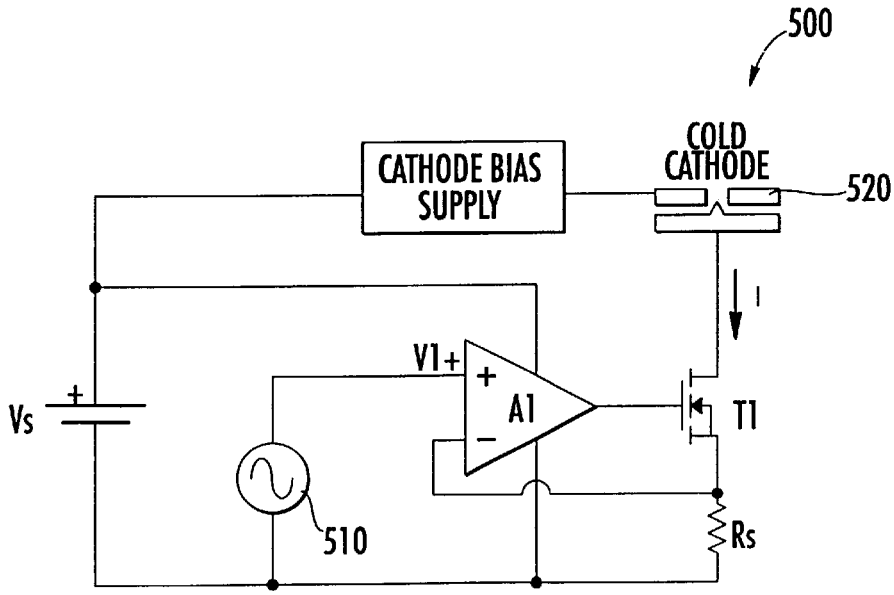
FIG. 6 is a schematic drawing of a current regulating circuit in which the reference signal is replaced by a time-varying input signal such that the regulated current varies at the same time function of the input, in accordance with an embodiment of the present invention.

FIG. 6 depicts a schematic diagram of a current regulating circuit 500 modified such that the fixed reference element is now replaced by a time-varying source 510, in accordance with an embodiment of the present invention. The time variation may represent the transmission of information, whether analog or digital, that can be intended for aural or visual interpretation, or interpretation by data processing equipment. The time variation of the source signal will be reflected in the current output of the cathode 520. In this sense, the current from the cathode becomes a linear function of the time-varying reference signal. The linear relationship follows from Ohm's Law as 1=(V1+)/Rs, as discussed in detail above. This embodiment of the invention is generally suited for application as an amplifying element or as the electron source in an emissive display. For example, this embodiment could be used to replace the cathode in a typical cathode ray tube (CRT) used for televisions and computer monitors, resulting in a considerable savings in power over thermionic cathodes. Additionally, this embodiment could also be used to replace the cathode in a vacuum tube, whether in a triode (or one of its variants with a greater number of electrodes) configuration, or a linear-beam configuration.

Figure 7:
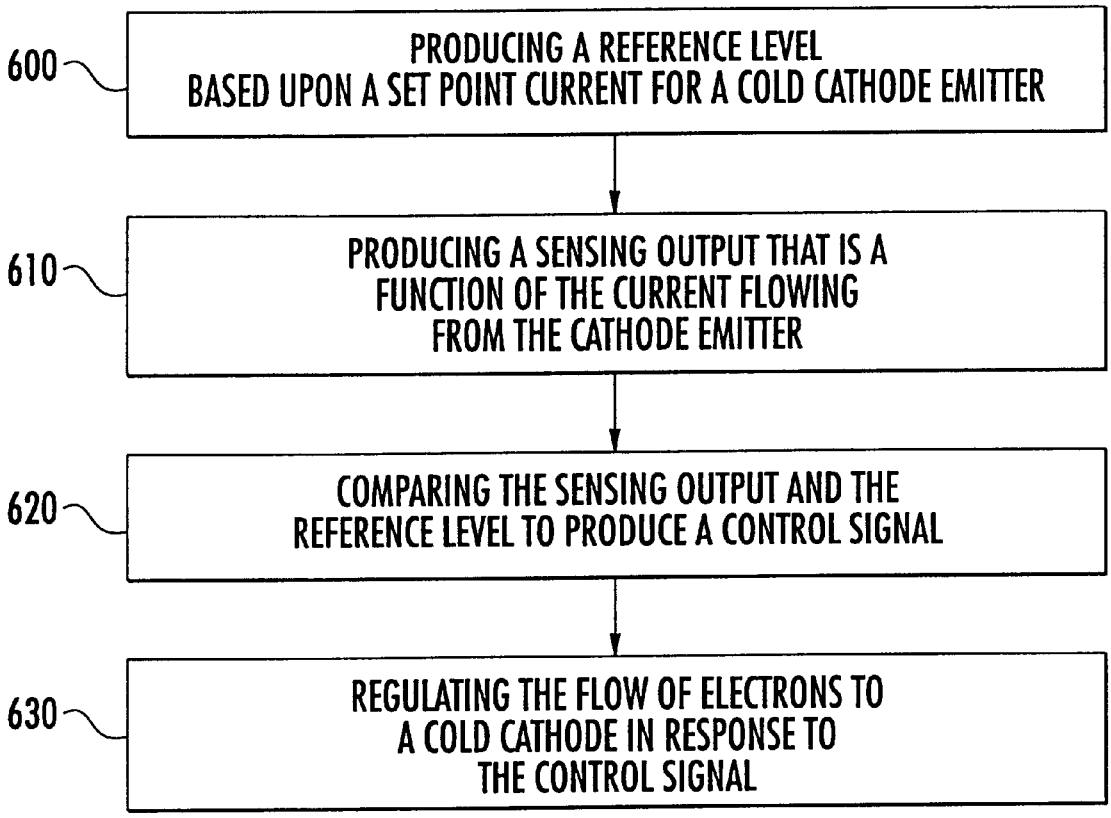
FIG. 7 is a flow chart diagram of a method for regulating current in a closed-loop cold cathode circuit in accordance with an embodiment of the present invention.

The present invention is also embodied in a method for cold cathode current regulation using a closed-loop circuit. FIG. 7 illustrates a flow diagram of the method for current regulation, in accordance with an embodiment of the present invention. At 600, a reference level is produced based upon a set point current for a cold cathode emitter. The reference level is produced by the reference element in conjunction with the circuit power supply. The reference level may be a fixed level or the level may vary as a function of the supply voltage, time or any other suitable parameter. The reference element may comprise a resistive voltage divider, a resistive voltage divider in combination with a non-inverting gain element, a time-varying input signal or any other component capable of providing the required reference signal.

At 610, a sensing output is produced that is a function of the current flowing through the cathode emitter and an associated sensing element. The current sensing element is typically a resistor or series of resistors capable of producing the necessary sensing output signal. The sensing output and the reference level are then combined and compared, at 620. This comparison process converts the sensing output and the reference level into a control signal. Typically, an amplifier is used as the current control element with inputs for the reference level and the sensing output.

After the current control element has converted the signals into a control signal, at 630 the flow of electrons to the cold cathode is regulated in response to the control signal. This process is self-repeating throughout the operational period of the cold cathode and allows for both short term and long term stabilization of the current being emitted from the cathode.

As such, the present invention is capable of providing for a closed-loop regulator circuit that provides field-based, cold cathodes with markedly improved current stabilization. As the testing of the closed-loop regulators has shown, current stabilization can be realized in both the short term and long term operational periods. Coefficients of variation in the range of 0.1% can be realized with the current regulators of the present invention. This benefit has wide spread applicability to numerous cathode devices, including but not limited to, analytical devices (e.g. scanning electron microscopes), CRT monitors and the like.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limiting the scope of the present invention in any way.

That which is claimed:

1. A closed-loop cold cathode current regulator circuit comprising:

a cold cathode having an emitter and an electrode that cooperates to extract electrons from said emitter;

a current limiting element in electrical communication with said emitter cathode that controls the flow of electrons to said cold cathode in response to a control signal;

a current sensing element in electrical communication with said current limiting element that produces an output signal that is a function of the current flowing through said emitter;

a current control element responsive to said current sensing element that based upon the output signal of said current sensing element and a reference level produces said control signal;

an alternating-current (AC) circuit power supply in electrical communication with said emitter that provides power to said circuit at a voltage dependent on a voltage of said AC circuit power supply; and a non-inverting gain element in electrical communication with said current control element that produces said reference level, wherein the gain element allows for a set point current level of said circuit to vary at a rate different from the rate of variation of said AC circuit power supply voltage.

2. The closed-loop cold cathode current regulator circuit of claim 1, wherein said current limiting element comprises at least one transistor.

3. The closed-loop cold cathode current regulator circuit of claim 1, wherein said current sensing element comprises a resistor.

4. The closed-loop cold cathode current regulator circuit of claim 1, wherein said current control element comprises an amplifier.

5. The closed-loop cold cathode current regulator circuit of claim 1, further comprising a cathode bias supply in electrical communication with said emitter for providing power to said emitter.

6. A method for regulating current in a closed-loop cold cathode circuit, the method comprising:

providing variable voltage power to the circuit through an alternating-current power supply;

producing a varying reference level based upon a set point current for a cold cathode emitter and dependent on the voltage of said alternating-current power supply;

producing a sensing output that is a function of the current flowing through said emitter;

comparing the sensing output and the reference level to produce a control signal; and regulating the flow of electrons to a cold cathode in response to said control signal.

* * * * *